US007918242B2

(12) United States Patent
Minamida et al.

(10) Patent No.: US 7,918,242 B2
(45) Date of Patent: Apr. 5, 2011

(54) PROCESSING SOLUTION SUPPLY SYSTEM, PROCESSING SOLUTION SUPPLY METHOD AND RECORDING MEDIUM FOR STORING PROCESSING SOLUTION SUPPLY CONTROL PROGRAM

(75) Inventors: Junya Minamida, Koshi (JP); Takahiro Okubo, Koshi (JP)

(73) Assignee: Tokyo Electron Limited, Tokyo (JP)

( * ) Notice: Subject to any disclaimer, the term of this patent is extended or adjusted under 35 U.S.C. 154(b) by 994 days.

(21) Appl. No.: 11/798,597

(22) Filed: May 15, 2007

(65) Prior Publication Data

US 2007/0269207 A1 Nov. 22, 2007

(30) Foreign Application Priority Data

May 19, 2006 (JP) ..... 2006-139910

(51) Int. Cl.
*F04F 1/10* (2006.01)

(52) U.S. Cl. ..... 137/209; 396/626; 141/98

(58) Field of Classification Search ..... 137/206, 137/209; 396/626; 141/98, 99
See application file for complete search history.

(56) References Cited

U.S. PATENT DOCUMENTS 4,676,404 A * 6/1987 Yamazaki et al. ..... 222/56
5,871,028 A * 2/1999 Liu ..... 137/209
6,267,132 B1 * 7/2001 Guarneri ..... 137/14
7,172,096 B2 * 2/2007 O'Dougherty ..... 222/100
2006/0102652 A1 5/2006 O'Dougherty

FOREIGN PATENT DOCUMENTS

| | | |
|---|---|---|
| JP | 60-084136 | 5/1985 |
| JP | 08-321482 | 12/1996 |
| JP | 09-260332 | 10/1997 |
| JP | 2001-007004 | 1/2001 |
| JP | 2002-246306 | 8/2002 |
| JP | 2004-128441 | 4/2004 |

OTHER PUBLICATIONS

Japanese Office Action issued on Sep. 26, 2010 for Application No. 2006-139910 with English translation.

* cited by examiner

*Primary Examiner* — Craig M Schneider
(74) *Attorney, Agent, or Firm* — Smith, Gambrell & Russell, LLP

(57) ABSTRACT

A processing solution pressurized at a constant pressure is supplied to improve processing accuracy. A controller receives a pressure signal indicating a measured pressure exerted on a processing solution from a pressure sensor, and controls an electropneumatic regulator on the basis of the pressure signal so that pressure on the discharge side of the electropneumatic regulator is constant. The controller decides whether the processing solution contained in a processing solution tank has been depleted on the basis of a difference between a desired pressure and the pressure measured by the pressure sensor, and switches pressurizing shut-off valves accordingly.

15 Claims, 11 Drawing Sheets

PROCESSING SOLUTION SUPPLY SYSTEM, PROCESSING SOLUTION SUPPLY METHOD AND RECORDING MEDIUM FOR STORING PROCESSING SOLUTION SUPPLY CONTROL PROGRAM

BACKGROUND OF THE INVENTION

1. Field of the Invention

The present invention relates to a system for and a method of supplying a processing solution, such as a resist solution or a developer, to a substrate, such as a semiconductor wafer or a glass substrate for an LCD, and a processing solution supply control program.

2. Description of the Related Art

Generally, a thin ITO film (indium tin oxide film) or an electrode pattern is formed on a semiconductor wafer or a glass substrate for an LCD (hereinafter, referred to as "wafer") by photolithography to fabricate a semiconductor device. Photolithography applies a photoresist to a wafer or the like to form a resist film on the wafer, exposes the resist film to light through a mask to form an image of a circuit pattern in the resist film, and processes the exposed resist film to form a circuit pattern in the resist film.

In photolithographic steps, a processing solution supply system is used for supplying the processing solution to the wafer. The processing solution supply system supplies the processing solution by pressure from a tank containing the processing solution or by suction by a pump plated in a supply line.

A processing solution supply system of this type disclosed in JP-A No. 2002-246306 (claims and FIG. 2) includes a plurality of processing solution tanks containing processing solutions, supply lines provided with selector valves and connecting the processing solution tanks to processing solution discharge nozzles, a temporary storage tank for temporarily storing the processing solutions from the processing solution tanks, and an exhaust line provided with a liquid surface detector and an air vent mechanism and connected to the temporary storage tank.

This known processing solution supply system can change the empty processing solution tank with another processing solution tank by controlling the selector valve by a controller which receives a detection signal from the liquid surface detector. Thus wafer or the like can be continuously processed.

Another processing liquid supply system disclosed in JP-A No. 2004-128441 (Paragraph No. 007 and FIG. 3) includes an exhaustion sensor capable of sensing the exhaustion of a processing solution tank and placed in a processing solution supply line connected to the processing solution tank instead of placing a liquid surface detector in a temporary storage tank.

It is important for such a processing solution supply system to supply a processing solution in a constant supply condition, such as a condition in which the processing solution is supplied at a constant pressure.

A pressurizing system that pressurizes a processing solution contained in a processing solution tank by a pressurizing means to supply the processing solution by pressure to a processing solution discharge nozzle has a problem that the processing solution cannot be supplied at a constant pressure because the pressure applied to the processing solution decreases as the amount of the processing solution contained in the processing solution tank decreases.

The pressure supply system cannot supply the processing solution while the processing solution tanks are changed. As mentioned in JP-A Nos. 2002-246306 and 2004-128441, such a problem may be solved by an arrangement that connects a plurality of processing solution tanks through selector valves to a temporary storage tank. This arrangement, however, needs pressure lines for connecting the processing solution tanks to a pressurizing means, and selector means placed in the pressure lines. Consequently, the processing solution supply system provided with such an arrangement has complicated, large construction.

SUMMARY OF THE INVENTION

The present invention has been made in view of the foregoing problems and it is therefore an object of the present invention to provide a processing solution supply system which supplies a processing solution contained in a processing solution tank by pressure exerted by a pressurizing means to a processing solution discharge nozzle, capable of supplying the processing solution at a constant pressure to improve process accuracy without being affected by the amount of the processing solution remaining in the processing solution tank, of changing a single processing solution tank, and of continuously carrying out a process using the processing solution without interrupting the process even if the processing solution contained in the processing solution tank is depleted, a processing solution supply method to be carried out by the processing solution supply system, and a recording medium storing a processing solution supply control program.

A processing solution supply system according to the present invention includes: processing solution supply system comprising: a processing solution tank containing a processing solution; a pressurizing means for pressurizing the processing solution contained in the processing solution tank to supply the processing solution by pressure; a temporary storage tank for temporarily storing the processing solution supplied by pressure from the processing solution tank, connected to the processing solution tank by a first processing solution supply line; and a second processing solution supply line connecting the temporary storage tank to a processing solution discharge nozzle; the improvement comprising: a pressure sensing means placed in the first processing solution supply line to measure pressure exerted on the processing solution contained in the processing solution tank; a first shut-off valve placed in the first processing solution supply line; a variable pressure regulating means placed in a main pressurizing line connecting the pressurizing means to the processing solution tank; a pressurizing shut-off valve placed in an auxiliary pressurizing line connecting the temporary storage tank to the pressurizing means; and a control means that controls the pressure regulating means on the basis of a pressure signal indicating a pressure measured by the pressure sensing means and provided by the pressure sensing means to regulate pressure on a discharge side of the pressure regulating means so that the processing solution is pressurized at a constant pressure, and switches the pressurizing shut-off valve, and the first shut-off valve placed in the first processing solution supply line when it is decided that the processing solution contained in the processing solution tank has been depleted on the basis of pressure difference between a desired pressure and a measured pressure measured by the pressure sensing means. The processing solution tank may be a double-wall tank including a flexible inner tank for containing the processing solution, and an outer tank surrounding the inner tank so as to define a pressurized space together with the inner tank and capable of holding pressure.

The pressure sensing means measures the pressure in the processing solution tank and provides the signal indicating the measured pressure, the control means controls the pressure regulating means in a feedback control mode using the signal indicating the measured pressure. Thus the pressure on the discharge side of the pressure regulating means can be kept constant and the processing solution can be always constantly supplied. When the processing solution contained in the processing solution tank is depleted and the processing solution tank needs to be changed, the processing solution tank can be changed without using a plurality of processing solution tanks. Moreover, the processing solution can be continuously supplied because the processing solution contained in the temporary storage tank can be directly pressurized and can be supplied to the processing solution discharge nozzle.

When the processing solution tank is a double-wall tank including a flexible inner tank for containing the processing solution, and an outer tank surrounding the inner tank so as to form a pressurized space and capable of holding pressure, the dissolution of a pressurizing fluid in the processing solution can be prevented.

The auxiliary pressure line may be connected to the pressurizing means and a part of the first processing solution supply line on the downstream side of the first shut-off valve placed in the first processing solution supply line or the auxiliary pressure line may be connected to the pressurizing means and a drain line connected to an upper part of the temporary storage tank. When the auxiliary pressure line is connected to the pressurizing means and the part of the first processing solution supply line on the downstream side of the first shut-off valve placed in the first processing solution supply line, it is preferable that the pressure sensing means for measuring the pressure in the temporary storage tank is placed on the downstream side of the pressurizing shut-off valve, the variable pressure regulating means is placed on the upstream side of the pressuring shut-off valve, and the processing solution supply system further includes a control means for controlling the pressure on the discharge side of the pressure regulating means on the basis of a signal provided by the pressure sensing means and indicating a pressure measured by the pressure sensing means so that a constant pressure may be applied to the processing solution.

The processing solution can be supplied from the temporary storage tank to the processing solution discharge nozzle by exerting pressure through the first processing solution supply line or the drain line to the processing solution contained in the temporary storage tank by the pressuring means and the processing solution can be thus continuously supplied. Since the drain line can be pressurized by connecting the pressurizing means to the drain line, the processing solution contained in the drain line can be returned to the temporary storage tank to reuse the processing solution. The pressure in the temporary storage tank can be measured by the pressure sensing means, the pressure on the discharge side of the pressure regulating means can be kept constant by measuring the pressure in the temporary storage tank by the pressure sensing means and controlling the pressure regulating means in a feedback control mode using the signal provided by the pressure sensing means by the control means, and the processing solution can be always constantly supplied.

According to the present invention, the improvement further includes a processing solution detecting means placed in the drain line connected to the upper part of the temporary storage tank, and a control means placed in the drain line on the basis of a detection signal provided by the processing solution detecting means.

The shut-off valve placed in the drain line is closed after bubbles remaining in the first processing solution supply line have been discharged through the drain line into the atmosphere after the processing solution tank is changed, and then the processing solution can be supplied. Therefore, a bubble removing operation for removing bubbles contained in the processing solution after the processing solution tank has been changed and a processing solution supply operation can be automatically accomplished.

In the processing solution supply system according to the present invention, it is preferable that the pressure sensing means is interposed between the processing solution tank and the first shut-off valve.

The processing solution supply system according to the present invention further includes an alarm means that provides an alarm signal in response to a signal from the control means; wherein the control means closes the first shut-off valve and opens the pressurizing shut-off valve upon the reception of a signal indicating that the processing solution has been depleted to apply pressure to the temporary storage tank by the pressurizing means so that the processing solution may be discharged through the processing solution discharge nozzle to continue processing the workpiece by a wet process, and gives a processing solution tank change request signal requesting changing the empty processing solution tank to the alarm means, and the alarm means provides an alarm upon the reception of the processing solution tank change request signal.

Thus the alarm means can indicate that the processing solution tank is empty and the processing solution tanks can be changed without fail.

The processing solution supply system according to the present invention further includes a liquid level measuring means, for measuring the level of the surface of the processing solution contained in the temporary storage tank, including a lower limit liquid level indicating means for indicating the drop of the surface of the processing solution contained in the temporary storage tank to a lower limit level, and a threshold liquid quantity indicating means for indicating the decrease of the quantity of the processing solution contained in the temporary storage tank to a predetermined threshold quantity of the processing solution to be discharged through the processing solution discharge nozzle for a predetermined number of processing cycles; wherein the control means receives signals from the lower limit liquid level indicating means and the threshold liquid quantity indicating means, gives an alarm signal indicating that the quantity of the processing solution contained in the temporary storage tank has decreased to the predetermined threshold quantity for the predetermined number of processing cycles to the alarm means upon the reception of the signal from the threshold liquid quantity indicating means, and the alarm means provides an alarm signal upon the reception of the alarm signal from the control means.

Preferably, the predetermined number of processing cycles is stored in the control means, the alarm signal is given to the alarm means upon the completion of the predetermined number of processing cycles after the threshold liquid quantity indicating means has provided the signal indicating the decrease of the quantity of the processing solution contained in the temporary storage tank to the predetermined threshold quantity, and the alarm means provides an alarm signal. Preferably, the control means stops discharging the processing solution through the processing solution discharge nozzle when the lower limit liquid level indicating means indicates the drop of the surface of the processing solution to the lower limit level. Preferably, the control means closes the pressurizing shut-off valve, opens the first shut-off valve and gives a pressurization signal to the pressure regulating means to supply the processing solution to the temporary storage tank after the empty processing solution tank has been replaced with a fully filled new processing solution tank and the processing solution tank change request signal has been stopped.

Thus the level of the surface of the processing solution contained in the temporary storage tank can be monitored by the lower limit liquid level indicating means and the threshold liquid quantity indicating means, and the empty processing solution tank can be replaced with a fully filled new processing solution tank while the wet process is being continued after the processing solution tank has become empty. When the decrease of the quantity of the remaining processing solution to the predetermined threshold quantity is detected, it is possible to know that the quantity of the processing solution remaining in the temporary storage tank is equal to the quantity of the processing solution for the predetermined processing cycles of the wet process. When the predetermined number of processing cycles of the wet process have been completed after the detection of the decrease of the remaining processing solution to the predetermined threshold quantity, an alarm signal is provided to that effect to prompt supplying the processing solution from the fully filled new processing solution tank to the temporary storage tank. The interruption of supplying the processing solution during the wet process can be avoided by stopping discharging the processing solution through the processing solution discharge nozzle when the lower limit liquid level indicating means indicates that the surface of the remaining processing solution has dropped to the lower limit liquid level. Thus the substrate can be prevented from being damaged. When the empty processing solution tank is replaced with the fully filled new processing solution tank and the processing solution tank change request signal is stopped, the pressurizing shut-off valve is closed, the first shut-off valve is opened, a pressurization signal is given to the pressure regulating means to supply the processing solution to the temporary storage tank. Thus the processing solution can be automatically supplied from the new processing solution tank to the temporary storage tank.

The present invention provides a processing solution supply method, to be carried out by the processing solution supply system of the present invention, including: controlling the pressure regulating means so that the pressure regulating means adjusts the pressure applied to the processing solution to apply a constant pressure to the processing solution when the pressure sensing means detects the drop of the pressure applied to the processing solution; closing the first shut-off valve and opening the pressurizing shut-off valve to apply pressure to the processing solution contained in the temporary storage tank to supply the processing solution from the temporary storage tank to the processing solution discharge nozzle when it is decided that the processing solution contained in the processing solution tank has been depleted on the basis of the difference between the desired pressure and a measured pressure measured by the pressure sensing means.

The present invention provides a processing solution supply method, to be carried out by the processing solution supply system of the present invention, including: pressurizing the temporary storage tank by closing the first shut-off valve and opening the pressurizing shut-off valve, when it is decided that the processing solution contained in the processing solution tank has been depleted, to continue the wet process for processing the substrate by the processing solution supplied from the temporary storage tank by applying pressure to the temporary storage tank; and providing a processing solution tank change request signal requesting changing the empty processing solution tank.

The present invention provides a processing solution supply method, to be carried out by the processing solution supply system of the present invention, including: providing an alarm signal indicating that the quantity of the processing solution contained in the temporary storage tank has decreased to the predetermined threshold quantity when the threshold liquid quantity indicating means detects the decrease of the quantity of the processing solution contained in the temporary storage tank to the predetermined threshold quantity; providing an alarm signal upon the completion of the predetermined number of processing cycles stored in the control means after the threshold liquid quantity indicating means has provided the signal indicating the decrease of the quantity of the processing solution contained in the temporary storage tank to the predetermined threshold quantity; stopping discharging the processing solution through the processing solution discharge nozzle upon the detection of the drop of the surface of the processing solution to the lower limit level by the lower limit level indicating means; and closing the pressurizing shut-off valve, opening the first shut-off valve and giving a pressurization signal to the pressure regulating means to supply the processing solution to the temporary storage tank after the empty processing solution tank has been replaced with a fully filled new processing solution tank and the processing solution tank change request signal has been stopped.

The present invention provides a recording medium storing a control program, to be executed by a computer to control the processing solution supply method according to the present invention, specifying: a control procedure for controlling the pressure regulating means so as to maintain exerting a constant pressure on the processing solution when the pressure sensing means detects the drop of pressure exerted on the processing solution; a processing solution depletion deciding procedure for deciding the depletion of the processing solution contained in the processing solution tank on the basis of pressure difference between a desired pressure and a measured pressure measured by the pressure sensing means; and a processing solution supply procedure for closing the first shut-off valve and opening the pressurizing shut-off valve, when it is decided that the processing solution contained in the processing solution tank has been depleted, to supply the processing solution from the temporary storage tank to the processing solution discharge nozzle by pressure applied to the processing solution contained in the temporary storage tank by the pressurizing means.

The present invention provides a recording medium storing a control program, to be executed by a computer to control the processing solution supply method according to the present invention, specifying: a processing solution depletion deciding procedure for deciding the depletion of the processing solution contained in the processing solution tank on the basis of pressure difference between a desired pressure and a measured pressure measured by the pressure sensing means; a valve operating procedure for closing the first shut-off valve and opening the pressurizing shut-off valve when it is decided that the processing solution contained in the processing solution tank has been depleted; a wet process continuing procedure for continuing a wet process for processing a substrate by applying pressure to the processing solution contained in the temporary storage tank to supply the processing solution from the temporary storage tank to the processing solution discharge nozzle; and an alarm signal providing procedure for providing an empty processing solution tank change request signal requesting changing the empty processing solution tank.

The present invention provides a recording medium storing a control program, to be executed by a computer to control the processing solution supply method according to the present invention, specifying: an alarm signal providing procedure for providing an alarm signal indicating the decrease of the quantity of the processing solution remaining in the temporary storage tank to the predetermined threshold quantity when the threshold liquid quantity indicating means detects the decrease of the quantity of the processing solution contained in the temporary storage tank to the predetermined threshold quantity; an alarm signal providing procedure for providing an alarm signal upon the completion of the predetermined number of processing cycles after the threshold liquid quantity indicating means has provided the signal indicating decrease of the quantity of the processing solution contained in the temporary storage tank to the predetermined threshold quantity to that effect; a processing solution discharge stopping procedure for stopping discharging of the processing solution through the processing solution discharge nozzle upon the detection of the drop of the surface of the processing solution contained in the temporary storage tank to the lower limit level; and a processing solution supply procedure for supplying the processing solution into the temporary storage tank by closing the pressuring shut-off valve, opening the first shut-off valve and giving a pressurization signal to the pressurizing means.

According to the present invention, the pressure sensing means measure the pressure in the processing solution tank, the control means controls the pressure regulating means in a feedback control mode, using the measured pressure. Since the output pressure on the pressurizing side of the pressure regulating means can be kept constant and the processing solution can be always constantly supplied, processing accuracy can be improved. The processing solution tank can be changed even if the processing solution supply system is not provided with a plurality of processing solution tanks, and the pressure can be directly applied to the processing solution contained in the temporary storage tank to supply the processing solution to the processing solution discharge nozzle. The process using the processing solution can be continued without interrupting the process even if the processing solution contained in the processing solution tank is depleted. Thus the process can be efficiently carried out and the system can be built in a small size.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

A processing solution supply system according to the present invention will be described as applied to a resist solution applying and developing system for applying a resist solution to a semiconductor wafer to form a resist film and developing a latent image formed in the resist film.

Figure 11:
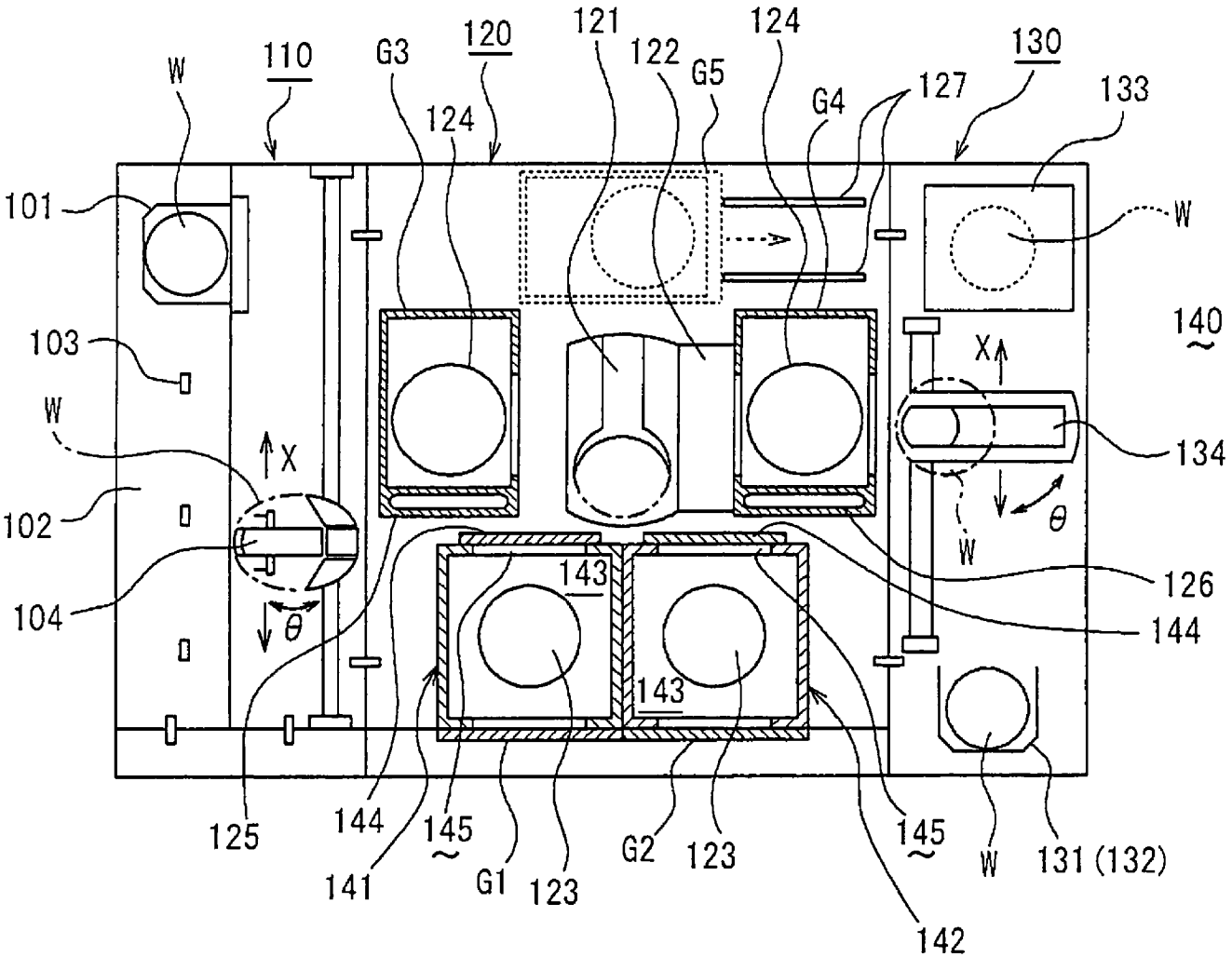
FIG. 11 is a schematic plan view of a coating and developing system for coating a surface of a semiconductor wafer with a resist solution and developing a latent image formed in the resist film to which the processing solution supply system according to the present invention is applied.
Figure 12:
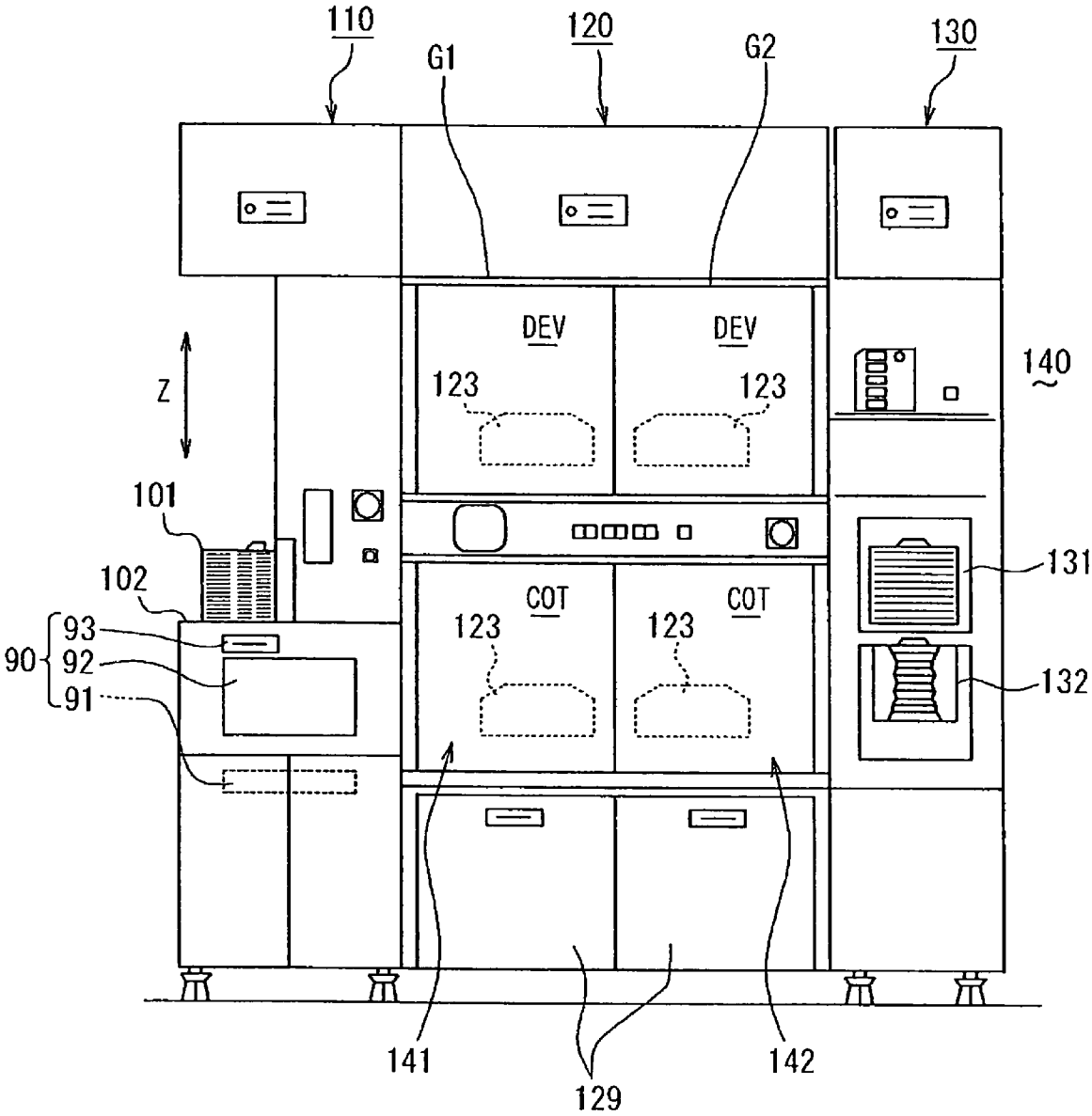
FIG. 12 is a schematic front elevation of the coating and developing system shown in FIG. 11.
Figure 13:
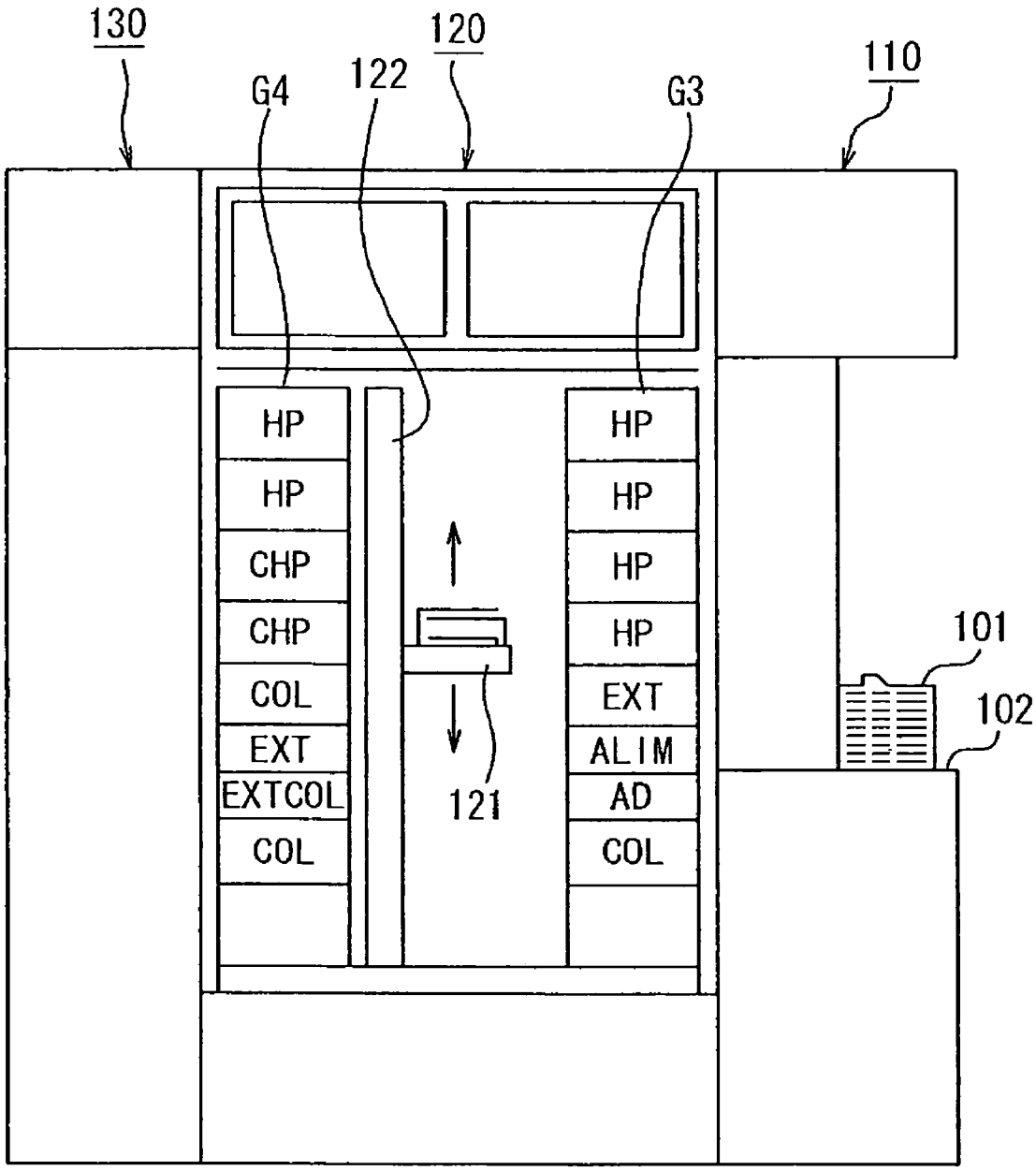
FIG. 13 is a schematic rear view of the coating and developing system shown in FIG. 11.

Referring to FIGS. 11 to 13, the coating and developing system includes, as principal components, cassette station 110, a processing station 120, and an interface unit 130 interposed between the processing station 120 and a developing system, not shown. A wafer cassette 101 containing, for example, twenty-five semiconductor wafers W (hereinafter, referred to simply as "wafers W"), namely, workpieces, is delivered to and is sent out from the cassette station 110 serving as a receiving unit for receiving wafers W and a delivery unit for sending out wafers W. The processing station 120 is provided with a processing system including single-wafer processing units for processing wafers W one by one by predetermined coating and developing processes. The processing units are arranged in layers at predetermined positions. The wafer W is transferred between the processing station 120 and the exposure system through the interface unit 130.

Referring to FIG. 11, the cassette station 110 has a cassette table 102 provided with, for example, four protrusions 103 arranged in a row in a horizontal cassette arranging direction parallel to a direction X. Wafer cassettes 101 are mounted on the protrusions 103 with their front sides respectively provided with openings facing the processing station 120. A wafer carrying device 104 provided with a pair of tweezers is movable in horizontal directions parallel to the direction X, in vertical direction in which the wafers W are stacked in the wafer cassettes 101 and is turnable in directions θ. The wafer carrying device 104 moves in the horizontal directions and the vertical directions to access the wafers W contained in the wafer cassette 101 selectively. The wafer carrying device 104 can carry the wafer W to an alignment unit ALIM and an extension unit EXT included in a third group G3 of the processing station 120.

Referring to FIG. 11, the processing station 120 has a main wafer carrying mechanism 121 of a vertical carrying type disposed in a chamber 122 formed in a central region of the processing station 120. All the processing units are layered in one or a plurality of groups. In this embodiment, the processing units are divided into five groups, namely, a first group G1, a second group G2, a third group G3, a fourth group G4 and a fifth group G5. The layered processing units of the first group G1 and the second group G2 are disposed side by side on the front side of the coating and developing system. The layered processing units of the third group G3 are disposed near the cassette station 110. The layered processing units of the fourth group G4 are disposed near the interface unit 130. The layered processing units of the fifth group G5 are disposed on the rear side of the coating and developing system.

As shown in FIG. 12, a coating unit COT and a developing unit DEV are stacked vertically in that order in two layers in the first group G1. The coating unit COT coats a wafer W held on a spin chuck, not shown, placed in a processing vessel 123 with a resist film by a predetermined process. The developing unit DEV processes a wafer W disposed opposite to a developer pouring device by a developing process to form a resist pattern by developing a latent image formed in a resist film. The coating unit COT is disposed under the developing unit DEV because the draining a resist solution from the coating unit COT needs a complicated mechanism and the coating unit COT requires complicated maintenance work. When necessary, the coating unit COT may be disposed above the developing unit DEV.

Referring to FIG. 13, the third group G3 includes a cooling unit COL, such as an oven type processing unit, for cooling a wafer W, an adhesion unit AD for processing a wafer W by a hydrophobicity imparting process, an alignment unit ALIM for aligning a wafer W, an extension unit EXT for receiving and delivering a wafer W, and four hot plate units HP for processing a wafer W by a baking process stacked vertically upward in that order in eight layers. Similarly, the fourth group G4 includes a cooling unit COL, such as an oven type processing unit, an extension cooling unit EXTCOL, and extension unit EXT, a cooling unit COL, two chilling hot plate units CHP having a quick-cooling function, and two hot plate units HP are stacked vertically upward in that order in eight layers.

The cooling unit COL and the extension cooling unit EXTCOL, which process a wafer W at low process temperatures, are placed in the lower layers. The hot plate units HP and the chilling hot plate units CHP, which process a wafer W at high process temperatures, are placed in the upper layers. Thus thermal interference between the units can be suppressed. Those processes may be stacked in order other than that shown in FIG. 13 when necessary.

As shown in FIG. 11, vertical ducts 125 and 126 are extended through the side walls of the layered units (spin type processing units) of the third group G3 and the side walls of the layered units (oven type units) of the fourth group G4, respectively. Clean air or air specially conditioned at a temperature flows down through the ducts 125 and 126. Radiation of heat generated by the oven type processing units of the third group G3 and the fourth group G4 toward the first group G1 and the second group G2 is intercepted by the ducts 125 and 126 to prevent the spinner type processing units of the first group G1 and the second group G2 from being affected by the heat generated by the oven type processing units of the third group G3 and the fourth group G4.

In this coating and developing system, the layered processing units of the fifth group G5 are disposed on the back side of the main wafer carrying mechanism 121. The layered processing units of the fifth group G5 can be longitudinally moved along guide rails 127 relative to the main wafer carrying mechanism 121. The processing units of the fifth group G5 are moved along the guide rails 127 to provide a space on the back side of the main wafer carrying mechanism 121. This space facilitates the maintenance of the main wafer carrying mechanism 121.

The interface unit 130 has a width, namely, a transverse dimension, equal to that of the processing station 120 and a short length, namely, a small longitudinal dimension. A portable pickup cassette 131 and a stationary buffer cassette 132 are disposed in two layers in a front part of the interface unit 130. An edge exposure unit 133 is disposed in a back part of the interface unit 130. The edge exposure unit 133 exposes a peripheral region and an identification mark region on a wafer W. A wafer carrying device 134, namely, a carrying means, is disposed in a central part of the interface unit 130. The carrying device 134 moves in the directions X and Z to carry a wafer W to the cassettes 131 and 132 and the edge exposure unit 133. The carrying device 134 can turn in directions θ. The carrying device 134 can carry a wafer W to the extension unit EXT of the fourth group G4 of the processing station 120 and to a transfer stage, not shown, included in the adjacent exposure system.

The coating and developing system is installed in a cleanroom 140. The processing units of the coating and developing system are kept in a high cleanliness by an efficient, vertical laminar flow system.

Operations of the coating and developing system will be described.

The wafer carrying device 104 accesses a cassette 101 mounted on the cassette table 102 and containing unprocessed wafers W and takes out one wafer W from the cassette 101. Then, the wafer carrying device 104 carries the wafer W to the alignment unit ALIM of the third group G3 disposed in the processing station 120. Then, the wafer carrying device 104 approaches the wafer W on a wafer stage 124 included in the alignment unit ALIM. The position of the wafer W placed on the wafer stage 124 is adjusted for orientation flat alignment and centering. Subsequently, the wafer carrying device 121 approaches the alignment unit ALIM from the opposite side and takes up the wafer W from the wafer stage 124.

In the processing station 120, first the main wafer carrying mechanism 121 carries to the adhesion unit AD of the third group G3. The wafer W is subjected to a hydrophobicity imparting process in the adhesion unit AD. Then, the main carrying mechanism 121 carries the wafer W from the adhesion unit AD to the cooling unit COL included in the third group G3 or the fourth group G4. The cooling unit COL cools the wafer W at a set temperature of, for example, 23° C. before the wafer W is subjected to a coating process. Then, the main carrying mechanism 121 carries out the cooled wafer W from the cooling unit COL and carries the wafer W to the coating unit COT included in the first group G1 or the second group G2. The coating unit COT coats a surface of the wafer W with a resist film of a uniform thickness by a spin coating process.

The main wafer carrying mechanism 121 carries the wafer W out of the coating unit COT after the completion of the coating process and carries the wafer W into the hot plate unit HP. The wafer W is placed on a stage in the hot plate unit HP and is subjected to the prebaking process. The prebaking process heats the wafer W at a predetermined temperature of, for example 100° C. for a predetermined time. Thus the solvent remaining in the resist film formed on the wafer W can be evaporated and can be removed. The main wafer carrying mechanism 121 carries the wafer W out of the hot plate unit HP after the completion of the prebaking process, and then carries the wafer W to the extension cooling unit EXTCOL of the fourth group G. The extension cooling unit EXTCOL cools the wafer W at a temperature of, for example, 24° C. suitable for an edge exposure process to be carried out by the edge exposure device 133. After the wafer W has been thus cooled, the main wafer carrying mechanism 121 carries the wafer W to the extension unit EXT overlying the extension cooling unit EXTCOL and places the wafer W on a stage, not shown, installed in the extension unit EXT. Then, the carrying device 134 of the interface unit 130 approaches the extension unit EXT from the opposite side, picks up the wafer W from the stage of the extension unit EXT, and then carries the wafer W to the edge exposure device 133 installed in the interface unit 130.

The wafer W is placed on the transfer stage of the exposure system after the wafer W has been processed by an exposure process by the exposure system. Then, the carrying device 134 of the interface unit 130 picks up the wafer W from the transfer stage, carries the wafer W to the extension unit EXT of the fourth group G of the processing station 120, and places the wafer W on the transfer stage of the extension unit EXT. In some cases, the wafer W is stored temporarily in the buffer cassette 132 disposed in the interface unit 130 before being returned to the processing station 120.

Then, the main wafer carrying mechanism 121 picks up the wafer W from the transfer stage, and carries the wafer W to the chilling hot plate unit CHP. The chilling hot plate unit CHP processes the wafer W by a post-exposure baking process to prevent the formation of a fringe or to induce an acid-catalytic reaction in a chemically amplified resist (CAR).

Then, the wafer W is carried into the developing unit DEV of the first group G1 or the second group G2 to subject the wafer W to a developing process. The developing process spreads a developer uniformly all over the resist film formed on the surface of the wafer W. Thus a latent image of a circuit pattern formed in the resist film formed on the surface of the wafer W is developed to form a predetermined circuit pattern on the wafer W. The developing process also removes unnecessary parts of the resist film formed on the peripheral part of the wafer W and an alignment mark region. After the completion of the developing process, the surface of the wafer W is cleaned with a rinsing liquid to wash off the residual developer from the surface of the wafer W.

Then, the main wafer carrying mechanism 121 carries the wafer W out of the developing unit DEV and carries the wafer W into the hot plate unit HP of the third group G3 or the fourth group G4. The wafer W is subjected to a post baking process in the hot plate unit HR The post baking process heats the wafer W at, for example, 100° C. The post baking process hardens the resist film swelled during the developing process and improves the chemical resistance of the circuit pattern.

After the completion of the post baking process, the main wafer carrying mechanism 121 carries the wafer W out of the hot plate unit HP and carries the wafer W into one of the cooling units COL. After the wafer W has been cooled at an ordinary temperature, the main wafer carrying mechanism 121 transfers the wafer W to the extension unit EXT of the third group G and places the wafer W on the stage, not shown, of the extension unit EXT. Then, the wafer carrying device 104 of the cassette station 110 picks up the wafer from the stage and inserts the wafer W into a predetermined slot of a cassette 101, for containing processed wafers W, mounted on the cassette table 102. Thus all the processes are completed.

The coating units shown in FIG. 11 will be described. The coating and developing system is provided with two coating units of the same type, namely, a first coating unit 141 (first processing unit 141) included in the first group G1, and a second coating unit 142 (second processing unit 142) included in the second group G2. The coating units 141 and 142 are provided with openings 145 in side walls on the side of the main wafer carrying mechanism 121 and capable of being closed by shutters 144, respectively.

The first coating unit 141 and the second coating unit 142 are the same in construction. Therefore, the construction of only the first coating unit 141 will be described with reference to FIG. 14. The first coating unit 141 has a casing 148, a spin chuck 149, namely, a rotating holding mean, a processing cup 123, and a nozzle assembly 80. The spin chuck 149 holds and rotates a wafer W and is disposed in the casing 148. The processing cup 123 covers a space surrounding the wafer W held on the spin chuck 149 and extending under the wafer W. The nozzle assembly 80 pours processing solutions including a resist solution, namely, a coating solution, and a solvent onto the surface of the wafer W.

The spin chuck 149 includes a shaft 152 connected to and driven for rotation by a spin motor 151 disposed in a lower part of a space enclosed by the casing 148, a chuck plate 149*a* attached to the upper end of the shaft 152, and a holding member, not shown, standing on a peripheral part of the chuck plate 149*a*. The holding member holds a wafer W by the circumferential edge thereof such that the wafer W floats above the chuck plate 149*a*.

The processing cup 123 is evacuated by a vacuum pump, namely, an evacuating means, by sucking out the interior atmosphere of the processing cup 123 through a discharge port formed in the bottom of the processing cup 123. A processing solution scattered around the spin chuck 149 by the rotating wafer W is drained through a drain 128 formed in the bottom of the processing cup 123. The processing cup 123 is vertically movable and, when necessary, can be removed for maintenance.

The nozzle assembly 80 is supported on an end part of a turning arm 154, namely, a moving member, capable of turning on a shaft 153. The nozzle assembly 80 includes a coating solution pouring nozzle 81 for pouring a coating solution, such as a resist solution, and a solvent pouring nozzle 82 for pouring out a solvent. A coating solution supply line 6, namely, a processing solution supply line, is connected to the coating solution pouring nozzle 81. A solvent supply line 83 is connected to the solvent pouring nozzle 82. The nozzles 81 and 82 are arranged side by side in a direction parallel to a radius of the wafer W. The nozzles 81 and 82 have pouring ports opening in the lower surface of the nozzle assembly 80. The coating solution pouring nozzle 81 is on the inner side of the solvent pouring nozzle 82 with respect to a radial direction. The coating solution pouring nozzle 81 and the solvent pouring nozzle 82 are spaced a predetermined distance apart from each other. The coating solution pouring nozzle 81 pours out the processing solution supplied thereto through the coating solution supply line 6, and the solvent pouring nozzle 82 pours out a solvent supplied thereto through the solvent supply line 83.

Figure 14:
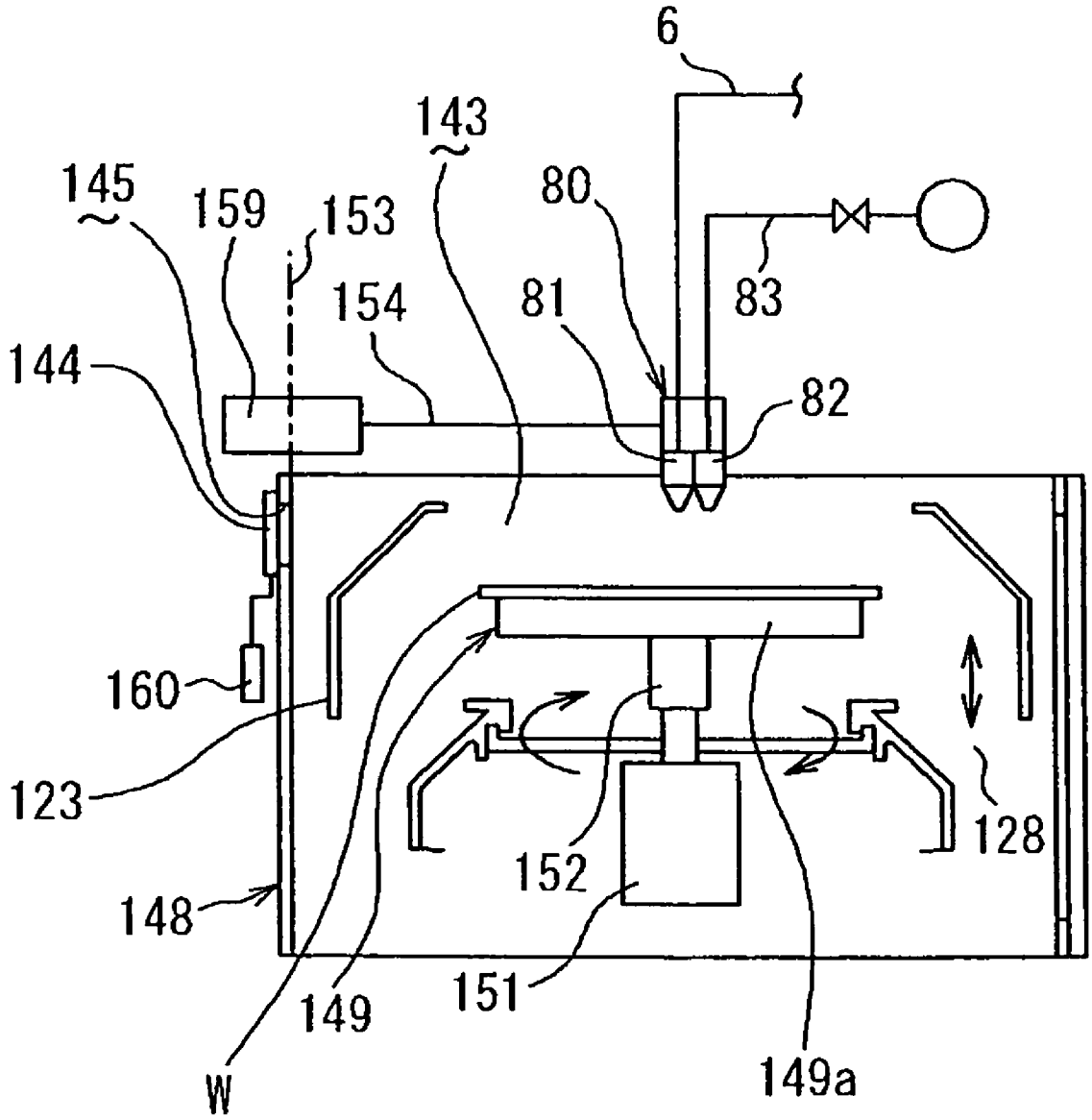
FIG. 14 is a schematic sectional view of a coating unit include in the coating and developing system shown in FIG. 11.

As shown in FIG. 14, the turning arm 154 is attached in a horizontal position to the upper end of the shaft 153 vertically standing outside the processing cup 123. A turning mechanism 159, namely, a nozzle moving mechanism, turns the shaft 153 to turn the turning arm 154 in a horizontal plane. The turning arm 154 is turned between a working position and a home position outside the processing cup 123 to form a coating film on the wafer W. The nozzle assembly 80 is located substantially above the center of the wafer W when the turning arm 154 is at the working position.

Processing solution supply systems according to the present invention will be described with reference to FIGS. 1 to 10.

Figure 1:
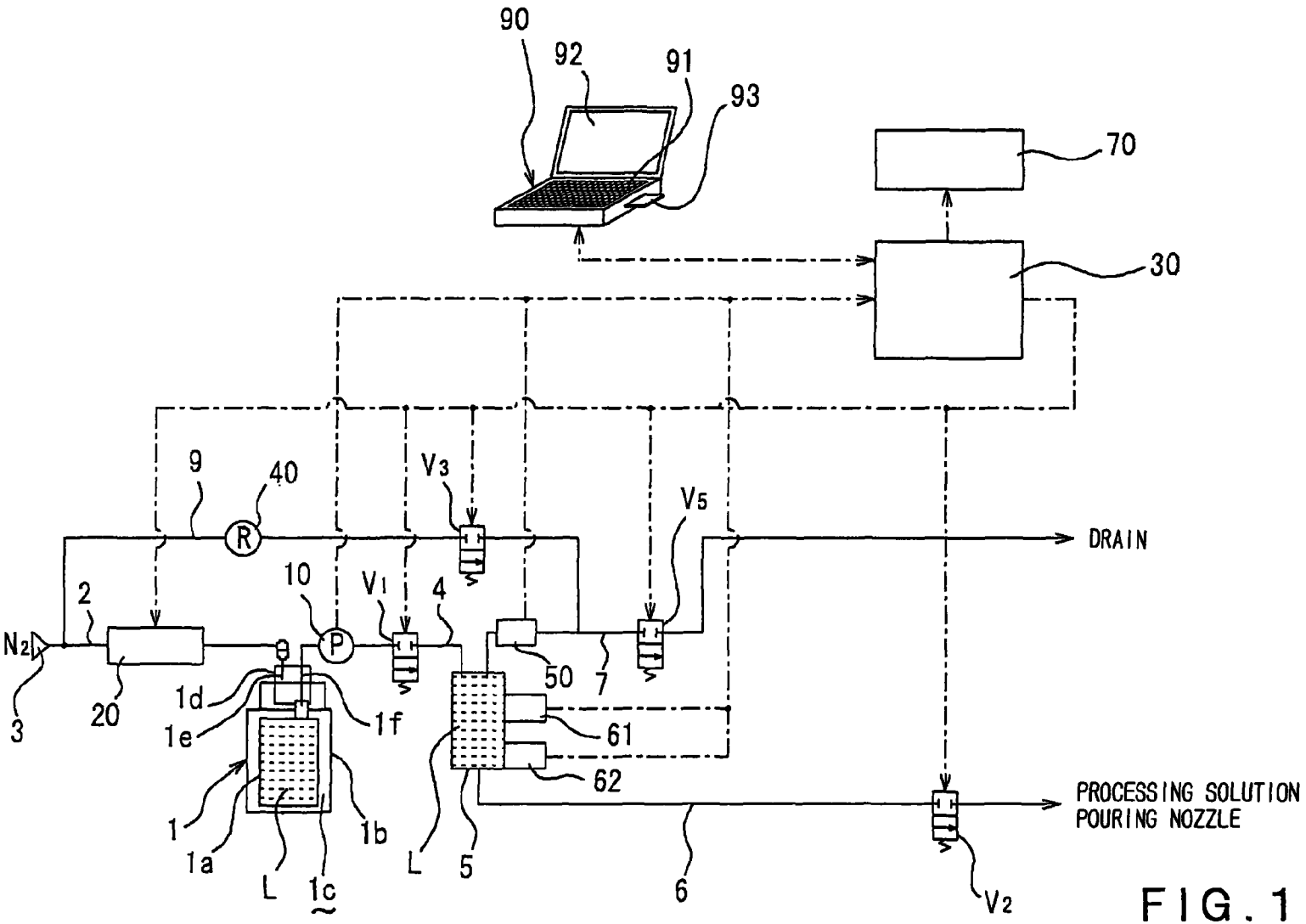
FIG. 1 is a schematic sectional view of a processing solution supply system in a first embodiment according to the present invention.

Referring to FIG. 1 showing a processing solution supply system in a first embodiment according to the present invention, the processing solution supply system includes a processing solution tank 1 containing a resist solution L, namely, a processing solution, a nitrogen gas source 3, namely, an inert gas source, connected to the processing solution tank 1 by a main pressurizing line 2 to the processing solution tank 1 to apply pressure to the processing solution contained in the processing solution tank 1, a reservoir tank 5, namely, a temporary storage tank, connected to the processing solution tank 1 by a first processing solution supply line 4, a second processing solution supply line 6, namely, a coating solution supply line, connecting the reservoir tank 5 to the coating solution pouring nozzle 81, namely, a processing solution pouring nozzle, a drain line 7 connected to an upper part of the reservoir tank 5, and an auxiliary pressurizing line 9 having one end connected to the nitrogen gas source 3 and the other end connected to the reservoir tank 5. The processing solution is supplied from the processing solution tank 1 through the first processing solution supply line 4 to the reservoir tank 5.

A pressure sensor 10, namely, a pressure sensing means, is placed in the first processing solution supply line 4 to measure pressure exerted on the processing solution contained in the processing solution tank 1. The pressure in the processing solution tank 1 is monitored to maintain a pressure of, for example, 45 kPa in the processing solution tank 1. A first shut-off valve V1 is placed in the first processing solution supply line 4 on the downstream side of the pressure sensor 10.

An electropneumatic regulator 20, namely, a pressure regulating means, is placed in the pressurizing line 2 interconnecting the processing solution tank 1 and the nitrogen gas source 3. The electropneumatic regulator 20 has a proportional solenoid, namely, an operating member, and a valve mechanism operated by the proportional solenoid for opening and closing. A controller 30, namely, a control means, controls the electropneumatic regulator 20. The controller 30 includes a computer 90 including a central processing unit (CPU) as a principal component. The proportional solenoid is operated by a control signal provided by the controller 30. The valve mechanism is controlled for opening and closing to regulate the pressure.

The pressure sensor 10 is electrically connected to the controller 30. The controller 30 receives a pressure signal indicating a measured pressure measured by the pressure sensor 10 and provided by the pressure sensor 10. The controller 30 controls the electropneumatic regulator 20 to keep the output pressure on the output side of the electropneumatic regulator 20 constant. The controller 30 can recognize the pressure in the processing solution tank 1 from the pressure signal received from the pressure sensor 10. The controller 30 controls the electropneumatic regulator 20 in a feedback control mode, using the pressure signal provided by the pressure sensor 10 to keep the pressure exerted on the processing solution L contained in the processing solution tank 1 constant so that a supply pressure that forces the processing solution L into the reservoir tank 5 may not decrease due to the reduction the pressure exerted on the processing solution L contained in the processing solution tank 1. If the measured pressure is below a lower limit, the controller 30 gives a control signal to the electropneumatic regulator 20 to increase the pressure exerted on the processing solution L contained in the processing solution tank 1. When the quantity of the processing solution L remaining in the processing solution tank 1 reaches a predetermined threshold quantity, i.e., when the controller 30 decides that the processing solution L contained in the processing solution tank 1 has been depleted and the processing solution tank 1 needs to be changed from the difference between a desired pressure given to the electropneumatic regulator 20 and the measured pressure measured by the pressure sensor 10, the controller 30 provides control signals to operate the first shut-off valve V1 and a pressurizing shut-off valve V3.

The processing solution tank 1 is a double-wall tank including a flexible inner tank 1*a* for containing the processing solution L made of a PE resin or a PET resin, and an outer tank 1*b* of a PE resin or a stainless steel surrounding the inner tank 1*a*. A pressure space 1*c* is formed between the inner tank 1*a* and the outer tank 1*b*. Open ends of the inner tank 1*a* and the outer tank 1*b* are covered in an air-tight fashion with a capping member 1*d*. The main pressurizing line 2 and the first processing solution supply line 4 are connected to a pressurizing gas inlet port 1*e* and a processing solution supply port 1*f* formed in the capping member 1*d*, respectively.

A filter, not shown, a second shut-off valve V2 and a non-suction pump, not shown, are [placed in the second processing solution supply line 6.

As shown in FIG. 1, a photosensor 50, namely, a processing solution sensor for sensing the processing solution in the drain line 7, and a drain shut-off valve V5 are placed in that order from the side of the reservoir tank 5 in the drain line 7 connected to the upper part of the reservoir tank 5. A level gage 61 for indicating the level of the processing solution L contained in the reservoir tank 5, such as a capacitance type level gage, and a lower limit level gage 62 are placed on the side wall of the reservoir tank 5. The level gage 61 and the lower limit level gage 62 are electrically connected to the controller 30. The controller 30 determines the condition of the processing solution L contained in the reservoir tank 5 from signals from the level gage 61 and the lower limit level gage 62.

The auxiliary pressurizing line 9 is connected to the nitrogen gas source 3 and a part of the drain line 7 between the photosensor 50 and the drain shut-off valve V5. A regulator 40 and a pressure shut-off valve V3 are placed in that order from the side of the nitrogen gas source 3 in the auxiliary pressurizing line 9. The pressure shut-off valve V3 is electrically connected to the controller 30. The pressure shut-off valve V3 is controlled for opening and closing operations by control signals provided by the controller 30. The pressure sensor 10 measures the presser exerted on the processing solution L contained in the processing solution tank 1. When the controller decides that the processing solution tank 1 is empty from the pressure measured by the pressure sensor 10, the controller 30 provides control signals to close the first shut-off valve V1 and to open the pressure shut-off valve V3. Consequently, nitrogen gas pressurized at a predetermined pressure of, for example, 45 kPa, namely, a pressurizing gas, is supplied from the nitrogen gas source 3 into the drain line 7 to return the processing solution contained in the drain line 7 into the reservoir tank 5. Thus the reservoir tank 5 is pressurized to supply the processing solution L by pressure into the second processing solution supply line 6 connected to the coating solution pouring nozzle.

Then, the capping member 1*d* is removed from the empty processing solution tank 1 and the capping member 1*d* is attached to a fully filled new processing solution tank 1. Thus the empty processing solution tank 1 is replaced with the fully filled new processing solution tank 1.

The photosensor 50 is electrically connected to the controller 30. The controller 30 switches the drain shut-off valve V5 and the first shut-off valve V1 on the basis of a detection signal given thereto by the photosensor 50. If the photosensor 50 detects the processing solution in the drain line 7, the photosensor 50 gives a signal to that effect to the controller 30. Then, the controller 30 recognizes that the reservoir tank 5 is filled up with the processing solution not containing any bubbles and provides a control signal to close the drain shut-off valve V5.

An alarm display 70 is electrically connected to the controller 30. When the controller 30 recognizes that the processing solution tank 1 is empty from a detection signal provided by the level gage 61, the controller 30 makes the display 70 display an alarm. The alarm display 70 displays an alarm indicating that the level of the processing solution L remaining in the reservoir tank 5 is between a level corresponding to the level gage 61 and a level corresponding to the lower limit level gage 62. The alarm displayed at this stage is "Empty level 1". When the level of the processing solution L contained in the reservoir tank 5 corresponds to the lower limit level gage 62, the display 70 displays an alarm. the alarm at this stage is "Empty level 3". When the alarm "Empty level 3" is displayed, the operator stops the operation of the coating and developing system; that is, the operator stops feeding a wafer W to the processing station.

As shown in FIG. 1, the computer 90 includes the controller 30 provided with a CPU as a principal component, an input device 91 connected to the controller 30, a display unit 92 for displaying a process sequence diagram to be used for process sequence organization, and a recording medium 93 storing control software and connected to the input device 91. The computer 90 is installed in the cassette table 102 of the cassette station 110 as shown in FIG. 12. When the computer 90 is installed in the cassette table 102, the input device is a drawer-type keyboard, the display unit 92 is a display mounted on the cassette table 102, and the recording medium 93 can be inserted in a slot formed in the cassette table 102.

The recording medium 93 may be a recording medium permanently incorporated into the computer 90 or a recording medium capable of loaded into and of unloaded from a read device included in the computer 90. Typically, the recording medium 93 is a hard disk drive in which control software is recorded beforehand by the maker of the coating and developing system. The recording medium 93 may be a removable disk storing the control software, such as a CD-ROM or a DVD-ROM. When such a removable disk is employed, an optical reader included in the computer 90 reads information from the removable disk. The recording medium 93 may be either a RAM (random access memory) or a ROM (read-only memory). The recording medium 93 may be a cassette ROM. The recording medium 93 may be any one of recording devices used in the computer technical field.

The computer 90 executes the control software to control the pressure sensor 10, the electropneumatic regulator 20, the shut-off valves V1, V2, V3 and V5, the level gage 61 and the lower limit level gage 62 to practice process conditions defined by a predetermined process sequence. The computer 90 executes general control operations for controlling the functional components of the coating and developing system including the main wafer carrying mechanism 121 and the spin chuck 149, and for controlling pouring the coating solution and the solvent respectively through the nozzles 81 and 82 to practice process conditions defined by a predetermined process sequence.

According to the present invention, a predetermined output pressure for the electropneumatic regulator 20, and a predetermined quantity of the processing solution L to be poured through the coating solution pouring nozzle 81 for a predetermined number of processing cycles are stored in the recording medium 93 of the computer 90. The main wafer carrying mechanism 121 is operated on the basis of a processing program to carry a wafer W.

Figure 2:
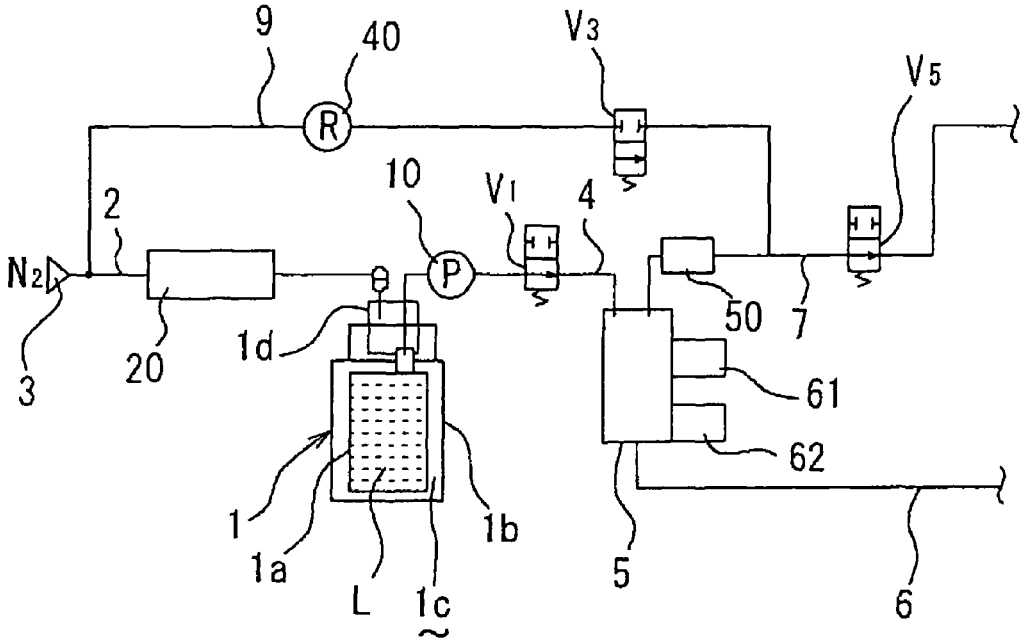
FIG. 2 is a schematic sectional view of assistance in explaining operations of the processing solution supply system in the first embodiment for removing air bubbles from a new processing solution.
Figure 3:
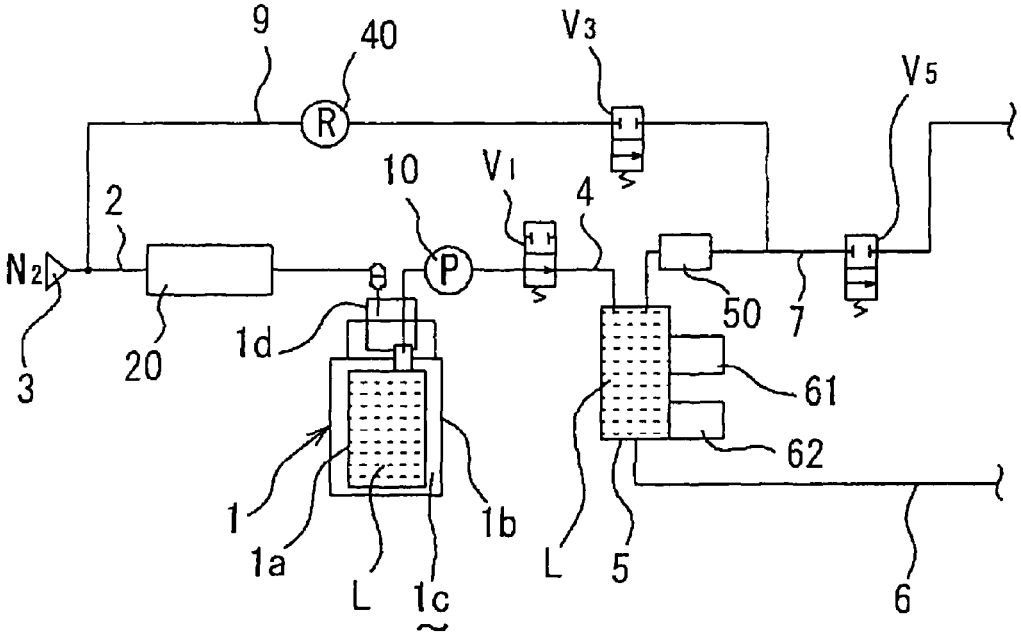
FIG. 3 is a schematic sectional view of the processing solution supply system in the first embodiment during an ordinary processing operation.

Operations of the processing solution supply system will be described with reference to FIGS. 2 to 8. In FIGS. 2 to 8, the controller 30 is omitted. A new processing solution tank 1 is connected to the processing solution supply system. Then, the first shut-off valve V1 is opened as shown in FIG. 2 to supply the processing solution L contained in the processing solution tank 1 to the reservoir tank 5. After the reservoir tank 5 has been thus filled up with the processing solution L, the controller 30 provides a control signal to close the drain shut-off valve V5 as shown in FIG. 3, so that the processing solution L is poured through the nozzle onto a wafer W to process the wafer W.

Figure 4:
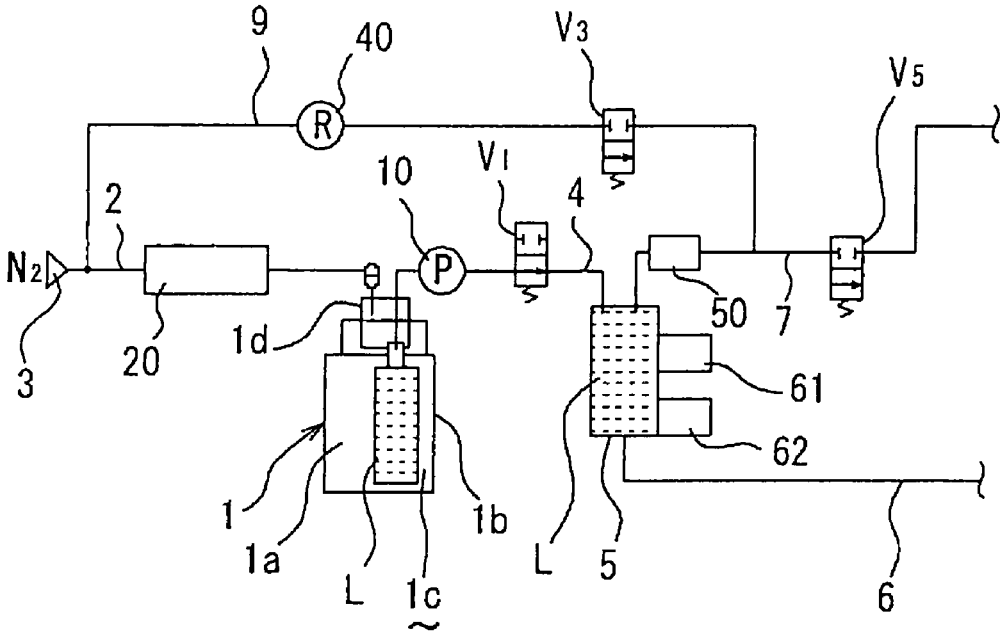
FIG. 4 is a schematic sectional view of assistance in explaining a pressure control operation for applying a constant pressure to the processing solution to be executed by the processing solution supply system in the first embodiment.

The pressure exerted on the processing solution L contained in the processing solution tank 1 decreases with the progress of an ordinary process. The pressure sensor 10 measures the pressure exerted on the processing solution L contained in the processing solution tank 1 and gives a signal indicating the measured pressure to the controller 30. Then, the controller 30 controls the electropneumatic regulator 20 in a feedback control mode using the signal received from the pressure sensor 10 to keep the pressure on the output side of the electropneumatic regulator 20 constant. Consequently, a predetermined pressure is exerted constantly on the processing solution L contained in the processing solution tank 1 to supply the processing solution L under the constant pressure to the processing solution pouring nozzle as shown in FIG. 4.

Figure 5:
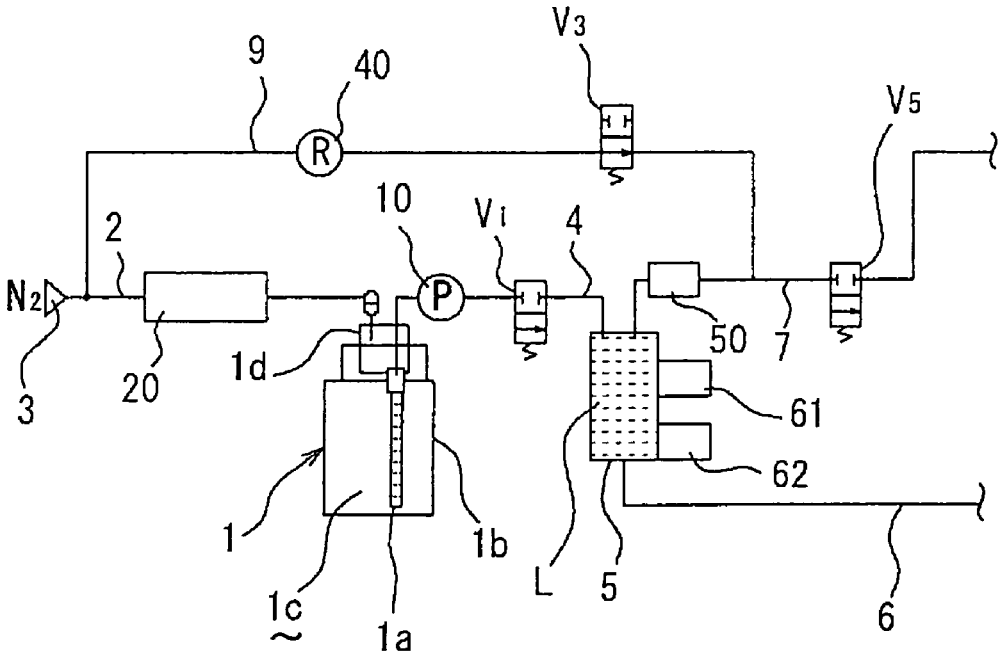
FIG. 5 is a schematic sectional view of assistance in explaining an operation for pressurizing a reservoir tank included in the processing solution supply system in the first embodiment to supply the processing solution by pressure.

When pressure difference between a desired pressure to be regulated by the electropneumatic regulator 20 and the measured pressure measured by the pressure sensor 10 increased to a critical point, and it is decided that that the quantity of the processing solution L contained in the processing solution tank 1 has decreased to a limit level and the processing solution tank 1 needs to be changed, a signal is given to the controller 30 to that effect. Then, the controller 30 gives a control signal to the alarm display 70 to make the alarm display 70 provide an alarm requesting changing the processing solution tank 1. At the same time, the processing solution remaining in the drain line 7 is returned into the reservoir tank 5 by closing the first shut-off valve V1 and opening the pressurizing shut-off valve V3 as shown in FIG. 5 to supply nitrogen gas from the nitrogen gas source 3 to the drain line 7. Thus the processing solution remaining in the drain line 7 can be used and the processing solution L is supplied from the reservoir tank 5 to the processing solution pouring nozzle.

Figure 6:
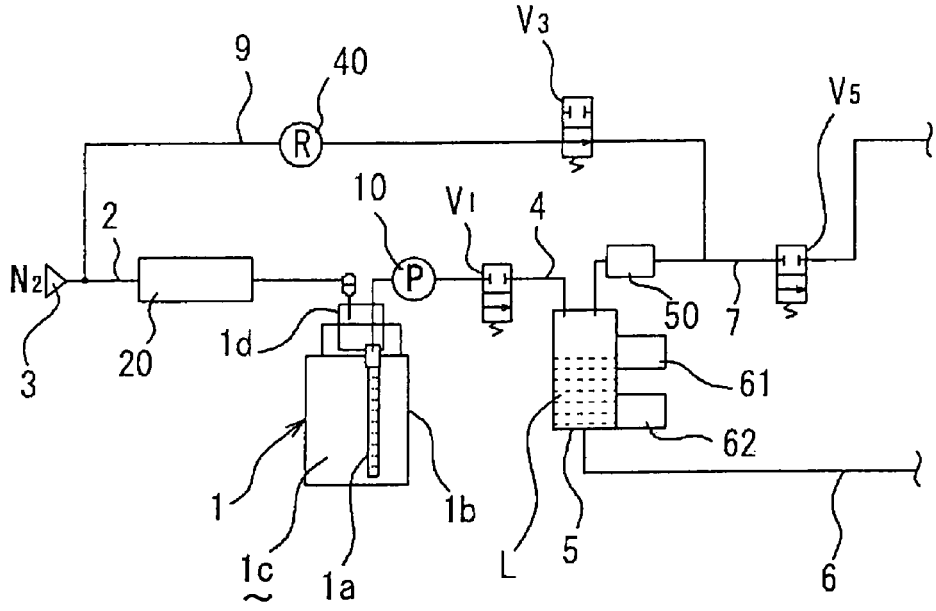
FIG. 6 is a schematic sectional view of an empty processing solution tank included in the processing solution supply system in the first embodiment.

The reservoir tank 5 is fully filled with the processing solution L when the processing solution tank 1 becomes empty and the first shut-off valve V1 is closed. If the empty processing solution tank 1 is not replaced with a fully filled new processing solution tank 1 in this state, the surface of the processing solution L remaining in the reservoir tank 5 drops to a level corresponding to the level gage 61 as shown in FIG. 6. When the level gage 61 detects the surface of the processing solution L contained in the reservoir tank 5, the alarm display 70 provides an alarm indicating "Empty level 1". At this time, the reservoir tank 5 contains a quantity of the processing solution L for processing a predetermined number of wafers W.

The controller 30 counts the number of wafers W processed after the level gage 61 has detected the surface of the processing solution L remaining in the reservoir tank 5 and the alarm indicating "Empty level 1" has been provided. At time when the count of wafers W coincides with a predetermined limit number stored in the recording medium 93 of the computer 90, the lower limit level gage 62 detects the surface of the processing solution L. Then, an alarm indicating "Empty level 2" is provided by software. When the surface of the processing solution L drops to the level corresponding to the lower limit level gage 62 and the lower limit level gage 62 detects the surface of the processing solution L, the alarm display 70 provides an alarm indicating "Empty level 3". When the alarm indicating "Empty level 3" is provided, the process is interrupted. The alarm indicating "Empty level 2" may be omitted and only the alarm indicating "Empty level 3" may be provided upon the detection of the surface of the processing solution L by the lower limit level gage 62.

Figure 7:
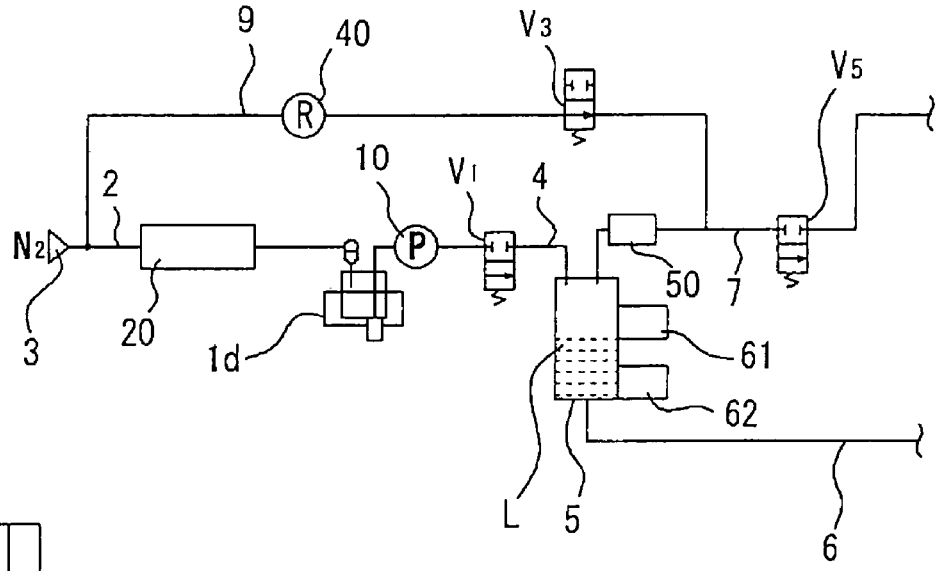
FIG. 7 is a schematic sectional view of assistance in explaining a processing solution tank changing operation for changing the processing solution tank included in the processing solution supply system in the first embodiment.
Figure 7:
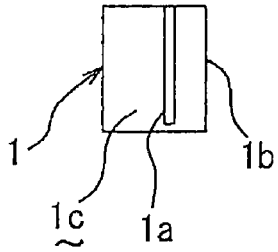

When information indicating that the processing solution tank 1 is empty is displayed by the alarm display 70, the operator removes the capping member 1*d* from the empty processing solution tank 1 as shown in FIG. 7, to replace the empty processing solution tank 1 with a fully filled new processing solution tank 1.

Figure 8:
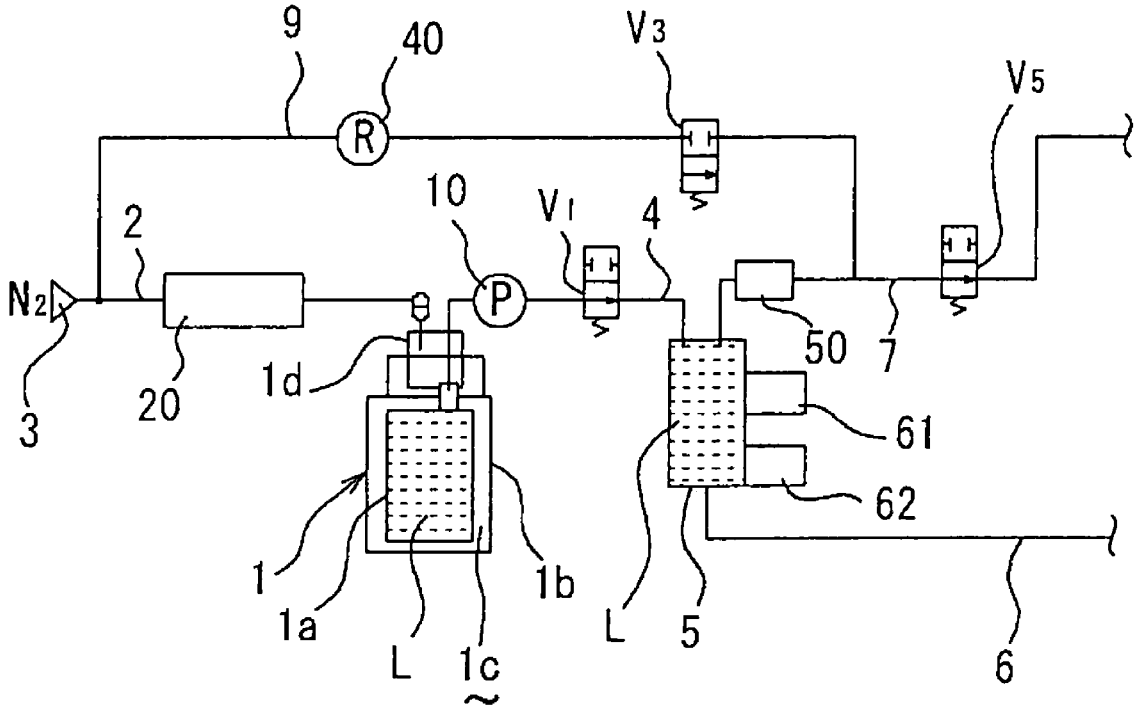
FIG. 8 is a schematic sectional view of assistance in explaining a bubble removing operation to be carried out after changing the processing solution tank to be executed by the processing solution supply system in the first embodiment.

The capping member 1*d* is attached to the new processing solution tank 1 and a changing request signal is stopped. At the same time, the first shut-off valve V1 and the drain shut-off valve V5 are opened as shown in FIG. 8 to discharge air remaining in an upper part of the new processing solution tank 1 and in the first processing solution supply line 4 into the atmosphere for deaeration. The photosensor 50 examines the processing solution in the drain line 7 for bubbles. When the photosensor 50 decides that bubbles have been completely eliminated, the photosensor 50 gives a signal to that effect to the controller 30. Then, the controller 30 provides control signals to close the drain shut-off valve V5 and to open the second shut-off valve V2 as shown in FIG. 3. Consequently, the processing solution L is supplied from the reservoir tank 5 to the processing solution pouring nozzle.

In the processing solution supply system in the first embodiment, the auxiliary pressuring line 9 has one end connected to the nitrogen gas source 3 and a part of the drain line 7 between the photosensor 50 and the drain shut-off valve V5. The auxiliary pressurizing line 9 does not need necessarily to be connected in such a manner. For example, in a processing solution supply system in a second embodiment according to the present invention shown in FIG. 9, the opposite ends of an auxiliary pressurizing line 9 is connected to a nitrogen gas source 3, and a part of a first processing solution supply line 4 on the downstream side of a first shut-off valve V1, respectively.

When the auxiliary pressuring line 9 is thus connected to the nitrogen gas source 3 and the first processing solution supply line 4, nitrogen gas can be supplied from the nitrogen gas source 3 through the first processing solution supply line 4 to the reservoir tank 5 to exert pressure on the processing solution L contained in the reservoir tank 5. Thus only the new processing solution can be supplied to the processing solution pouring nozzle for processing without using the processing solution remaining in the drain line 7.

Figure 9:
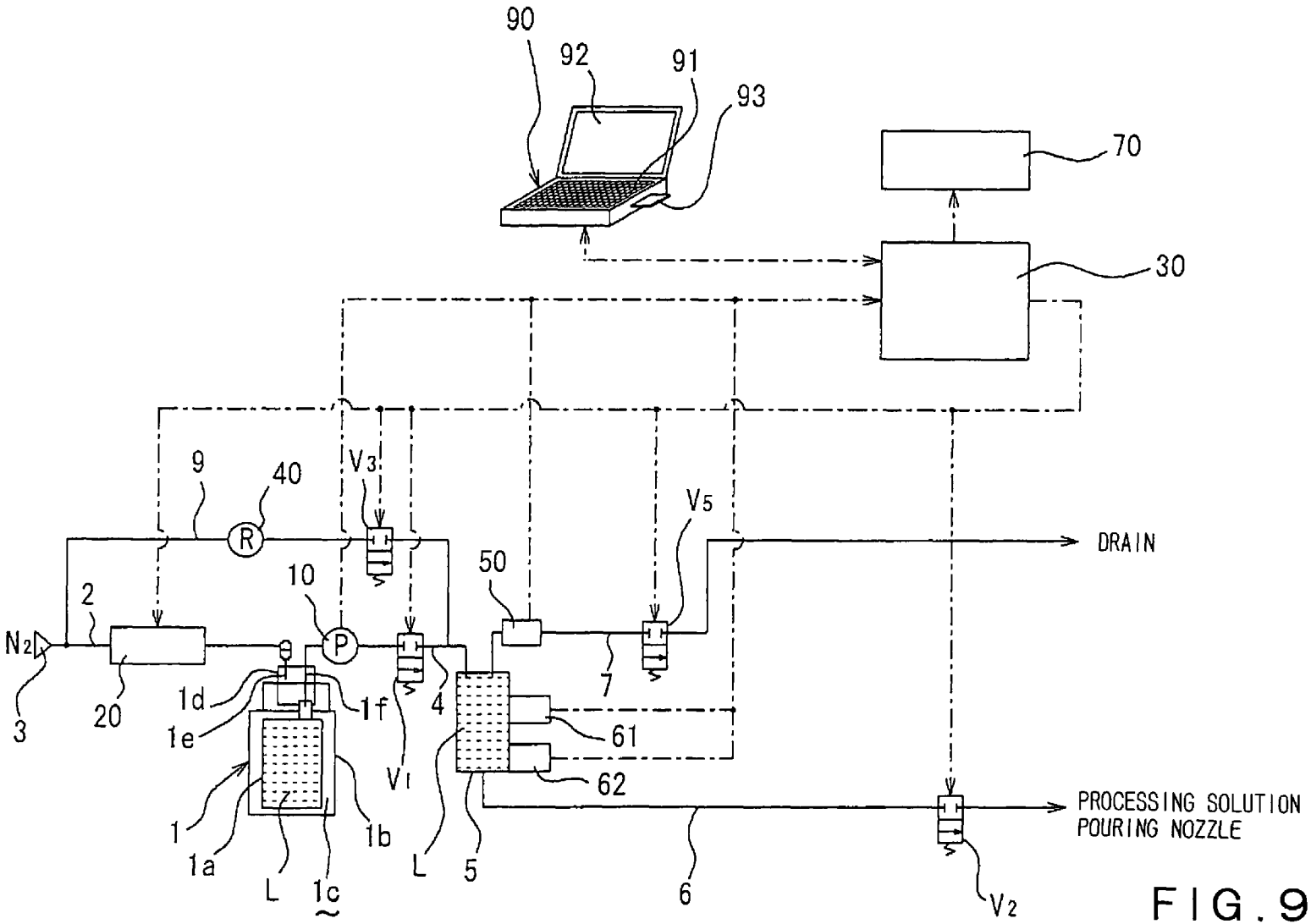
FIG. 9 is a schematic sectional view of a processing solution supply system in a second embodiment according to the present invention.

Other parts of the processing solution supply system in the second embodiment shown in FIG. 9 are the same as corresponding parts of the processing solution supply system in the first embodiment, and hence the parts shown in FIG. 9 corresponding to those of the processing solution supply system in the first embodiment are designated by the same reference characters and the description thereof will be omitted.

Figure 10:
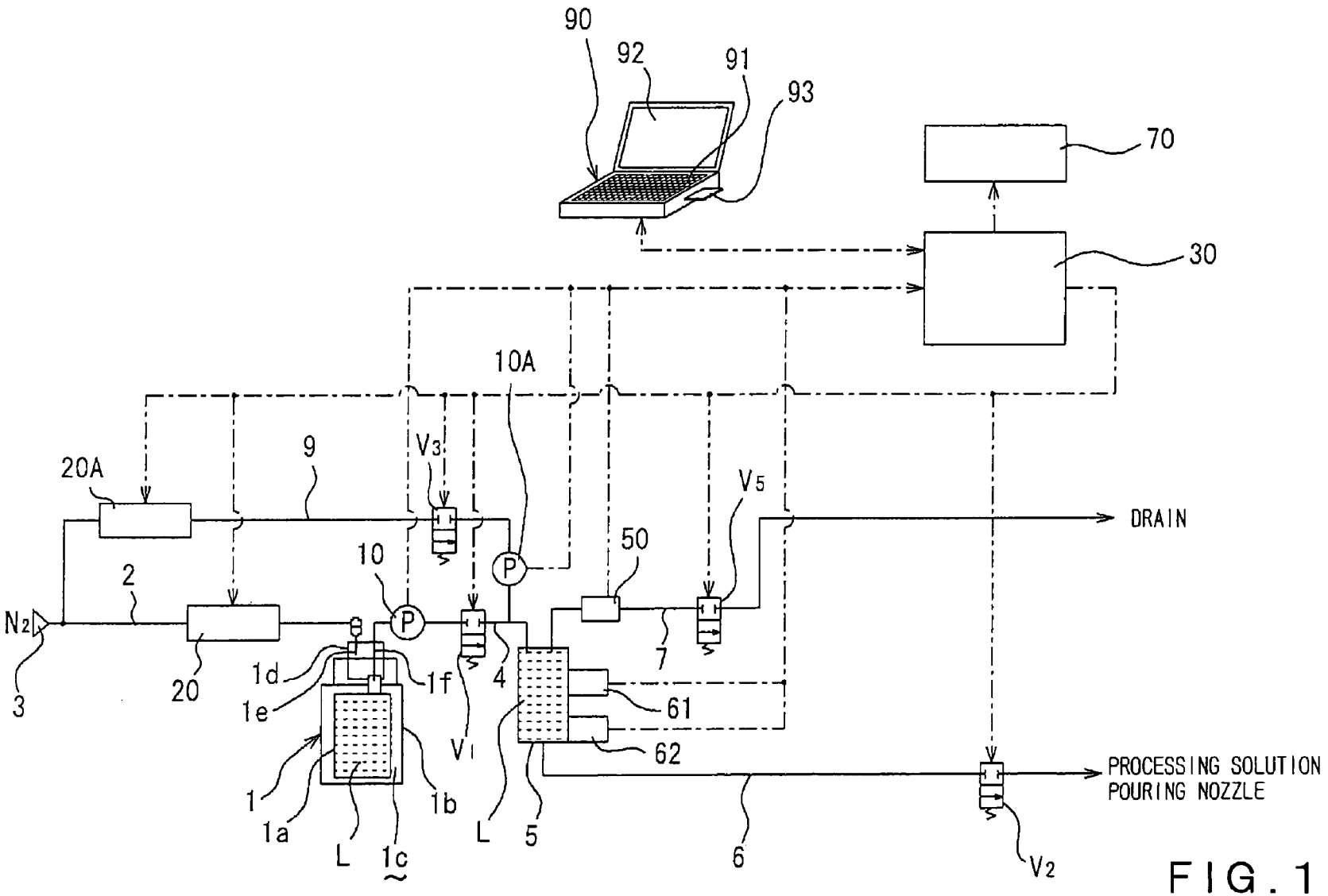
FIG. 10 is a schematic sectional view of a processing solution supply system in a third embodiment according to the present invention.

In a schematic sectional view of a processing solution supply system in a third embodiment according to the present invention shown in FIG. 10, a pressure sensor 10A, namely, a pressure measuring means, for measuring pressure exerted on a processing solution L contained in a reservoir tank 5 is placed in a part of the auxiliary pressurizing line 9 on the downstream side of a pressurizing shut-off valve V3, and an electropneumatic regulator 20A equivalent in a pressure regulating function to the electropneumatic regulator 20 is placed in a part of an auxiliary pressurizing line 9 on the upstream side of a pressurizing shut-off valve V3. The pressure sensor 10A gives a pressure signal indicating a measured pressure to a controller 30. The controller 30 provides a control signal to control the electropneumatic regulator 20A so that the output pressure of the electropneumatic regulator 20A is constant.

Thus nitrogen gas of a constant pressure can be supplied from a nitrogen gas source 3 to the reservoir tank 5. Consequently, the processing solution L can be supplied at a constant pressure from the reservoir tank 5 into a second processing solution supply line 6 connected to the processing solution pouring nozzle.

Other parts of the processing solution supply system in the third embodiment shown in FIG. 10 are the same as corresponding parts of the processing solution supply system in the first embodiment, and hence the parts shown in FIG. 10 corresponding to those of the processing solution supply system in the first embodiment are designated by the same reference characters and the description thereof will be omitted.

Although the processing solution supply systems and processing solution supply methods embodying the present invention have been described as applied to the coating and developing system for coating a wafer with a resist film and developing a latent image formed in the resist film, the present invention is applicable to processing solution supply systems and methods for supplying a processing solution other than the resist solution, such as a developer.

What is claimed is:

1. A processing solution supply system comprising:

a processing solution tank containing a processing solution;

a pressurizing means for pressurizing the processing solution contained in the processing solution tank to supply the processing solution by pressure;

a temporary storage tank for temporarily storing the processing solution supplied by pressure from the processing solution tank, connected to the processing solution tank by a first processing solution supply line; and a second processing solution supply line connecting the temporary storage tank to a processing solution discharge nozzle;

the improvement comprising:

a pressure sensing means placed in the first processing solution supply line to measure pressure exerted on the processing solution contained in the processing solution tank;

a first shut-off valve placed in the first processing solution supply line;

a variable pressure regulating means placed in a main pressurizing line connecting the pressurizing means to the processing solution tank;

a pressurizing shut-off valve placed in an auxiliary pressurizing line connecting the temporary storage tank to the pressurizing means;

a control means that controls the pressure regulating means on the basis of a pressure signal indicating a pressure measured by the pressure sensing means and provided by the pressure sensing means to regulate pressure on a discharge side of the pressure regulating means so that the processing solution is pressurized at a constant pressure, and switches the pressurizing shut-off valve, and the first shut-off valve placed in the first processing solution supply line when it is decided that the processing solution contained in the processing solution tank has been depleted on the basis of a pressure difference between a desired pressure and a measured pressure measured by the pressure sensing means, wherein the auxiliary pressurizing line is connected to the pressurizing means, and a drain line is connected to an upper part of the temporary storage tank.

2. The processing solution supply system according to claim 1, wherein the processing solution tank is a double-wall tank including a flexible inner tank for containing the processing solution, and an outer tank surrounding the inner tank so as to define a pressurized space together with the inner tank and capable of holding pressure.

3. The processing solution supply system according to claim 1 further comprising a processing solution detecting means placed in a drain line connected to an upper part of the temporary storage tank, and a control means for controlling a drain shut-off valve placed in the drain line for opening and closing on the basis of a detection signal provided by the processing solution detecting means.

4. The processing solution supply system according to claim 1, wherein the pressure sensing means is interposed between the processing solution tank and the first shut-off valve.

5. The processing solution supply system according to claim 1 further comprising an alarm means that provides an alarm signal in response to a signal given thereto by the control means;

wherein the control means closes the first shut-off valve and opens the pressurizing shut-off valve upon the reception of a signal indicating that the processing solution has been depleted to apply pressure to the temporary storage tank by the pressurizing means so that the processing solution may be discharged through the processing solution discharge nozzle to continue processing the workpiece by a wet process, and gives a processing solution tank change request signal requesting changing the empty processing solution tank to the alarm means, and the alarm means provides an alarm upon the reception of the processing solution tank change request signal.

6. The processing solution supply system according to claim 1 further comprising a liquid level measuring means, for measuring the level of the surface of the processing solution contained in the temporary storage tank, including a lower limit liquid level indicating means for indicating the drop of the surface of the processing solution contained in the temporary storage tank to a lower limit level, and a threshold liquid quantity indicating means for indicating the decrease of the quantity of the processing solution contained in the temporary storage tank to a predetermined threshold quantity of the processing solution to be discharged through the processing solution discharge nozzle for a predetermined number of processing cycles;

wherein the control means receives signals from the lower limit liquid level indicating means and the threshold liquid quantity indicating means, gives an alarm signal indicating that the quantity of the processing solution contained in the temporary storage tank has decreased to the predetermined threshold quantity for the predetermined number of processing cycles to the alarm means upon the reception of the signal from the threshold liquid quantity indicating means, and the alarm means provides an alarm signal upon the reception of the alarm signal from the control means.

7. The processing solution supply system according to claim 6, wherein the predetermined number of processing cycles is stored in the control means, the alarm signal is given to the alarm means upon the completion of the predetermined number of processing cycles after the threshold liquid quantity indicating means has provided the signal indicating the decrease of the quantity of the processing solution contained in the temporary storage tank to the predetermined threshold quantity, and the alarm means provides an alarm signal.

8. The processing solution supply system according to claim 6, wherein the control means stops discharging the processing solution through the processing solution discharge nozzle when the lower limit liquid level indicating means indicates the drop of the surface of the processing solution to the lower limit level.

9. The processing solution supply system according to claim 6, wherein the control means closes the pressurizing shut-off valve, opens the first shut-off valve and gives a pressurization signal to the pressure regulating means to supply the processing solution to the temporary storage tank after the empty processing solution tank has been replaced with a fully filled new processing solution tank and the processing solution tank change request signal has been stopped.

10. A processing solution supply method, to be carried out by the processing solution supply system according to claim 1, comprising:

controlling the pressure regulating means so that the pressure regulating means operates so as to exert a constant pressure on the processing solution when the pressure sensing means detects the drop of the pressure exerted on the processing solution; and closing the first shut-off valve and opening the pressurizing shut-off valve to exert pressure on the processing solution contained in the temporary storage tank to supply the processing solution from the temporary storage tank to the processing solution discharge nozzle when it is decided that the processing solution contained in the processing solution tank has been depleted on the basis of the difference between the desired pressure and a measured pressure measured by the pressure sensing means.

11. A processing solution supply method, to be carried out by the processing solution supply system according to claim 5, comprising:

pressurizing the temporary storage tank by closing the first shut-off valve and opening the pressurizing shut-off valve, when it is decided that the processing solution contained in the processing solution tank has been depleted, to continue the wet process for processing the substrate by the processing solution supplied from the temporary storage tank by applying pressure to the temporary storage tank; and providing a processing solution tank change request signal requesting changing the empty processing solution tank.

12. A processing solution supply method, to be carried out by the processing solution supply system according to claim 6, comprising:

providing an alarm signal indicating that the quantity of the processing solution contained in the temporary storage tank has decreased to the predetermined threshold quantity when the threshold liquid quantity indicating means detects the decrease of the quantity of the processing solution contained in the temporary storage tank to the predetermined threshold quantity;

providing an alarm signal upon the completion of the predetermined number of processing cycles stored in the control means after the threshold liquid quantity indicating means has provided the signal indicating the decrease of the quantity of the processing solution contained in the temporary storage tank to the predetermined threshold quantity;

stopping discharging the processing solution through the processing solution discharge nozzle upon the detection of the drop of the surface of the processing solution to the lower limit level by the lower limit level indicating means;

closing the pressurizing shut-off valve, opening the first shut-off valve and giving a pressurization signal to the pressure regulating means to supply the processing solution to the temporary storage tank after the empty processing solution tank has been replaced with a fully filled new processing solution tank and the processing solution tank change request signal has been stopped.

13. A recording medium storing a control program, to be executed by a computer to control the processing solution supply method according to claim 10, specifying:

a control procedure for controlling the pressure regulating means so as to maintain exerting a constant pressure on the processing solution when the pressure sensing means detects the drop of pressure exerted on the processing solution;

a processing solution depletion deciding procedure for deciding the depletion of the processing solution contained in the processing solution tank from pressure difference between a desired pressure and a measured pressure measured by the pressure sensing means;

a processing solution supply procedure for closing the first shut-off valve and opening the pressurizing shut-off valve, when it is decided that the processing solution contained in the processing solution tank has been depleted, to supply the processing solution from the temporary storage tank to the processing solution discharge nozzle by pressure applied to the processing solution contained in the temporary storage tank by the pressurizing means.

14. A recording medium storing a control program, to be executed by a computer to control the processing solution supply method according to claim 11, specifying:

a processing solution depletion deciding procedure for deciding the depletion of the processing solution contained in the processing solution tank on the basis of pressure difference between a desired pressure and a measured pressure measured by the pressure sensing means;

a valve operating procedure for closing the first shut-off valve and opening the pressurizing shut-off valve when it is decided that the processing solution contained in the processing solution tank has been depleted;

a wet process continuing procedure for continuing a wet process for processing a substrate by applying pressure to the processing solution contained in the temporary storage tank to supply the processing solution from the temporary storage tank to the processing solution discharge nozzle; and an alarm signal providing procedure for providing an empty processing solution tank change request signal requesting changing the empty processing solution tank.

15. A recording medium storing a control program, to be executed by a computer to control the processing solution supply method according to claim 12, specifying:

an alarm signal providing procedure for providing an alarm signal indicating the decrease of the quantity of the processing solution remaining in the temporary storage tank to the predetermined threshold quantity when the threshold liquid quantity indicating means detects the decrease of the quantity of the processing solution contained in the temporary storage tank to the predetermined threshold quantity;

an alarm signal providing procedure for providing an alarm signal upon the completion of the predetermined number of processing cycles after the threshold liquid quantity indicating means has provided the signal indicating decrease of the quantity of the processing solution contained in the temporary storage tank to the predetermined threshold quantity to that effect;

a processing solution discharge stopping procedure for stopping discharging the processing solution through the processing solution discharge nozzle upon the detection of the drop of the surface of the processing solution contained in the temporary storage tank to the lower limit level; and a processing solution supply procedure for supplying the processing solution into the temporary storage tank by closing the pressuring shut-off valve, opening the first shut-off valve and giving a pressurization signal to the pressurizing means.

* * * * *